US009555928B2

(12) United States Patent
Ettlin

(10) Patent No.: US 9,555,928 B2
(45) Date of Patent: Jan. 31, 2017

(54) CARTRIDGE AND MULTICOMPONENT CARTRIDGE

(75) Inventor: Josef Ettlin, Eichberg (CH)

(73) Assignee: SULZER MIXPAC AG, Haag (CH)

( * ) Notice: Subject to any disclaimer, the term of this patent is extended or adjusted under 35 U.S.C. 154(b) by 0 days.

(21) Appl. No.: 14/239,721

(22) PCT Filed: Aug. 20, 2012

(86) PCT No.: PCT/EP2012/066192
§ 371 (c)(1),
(2), (4) Date: Feb. 19, 2014

(87) PCT Pub. No.: WO2013/056874
PCT Pub. Date: Apr. 25, 2013

(65) Prior Publication Data

US 2014/0203023 A1 Jul. 24, 2014

(30) Foreign Application Priority Data

Oct. 17, 2011 (EP) ..... 11185383

(51) Int. Cl.
*B67D 7/70* (2010.01)
*B65D 25/20* (2006.01)
(Continued)

(52) U.S. Cl.
CPC ..... *B65D 25/20* (2013.01); *B01F 5/0615* (2013.01); *B01F 13/0023* (2013.01);
(Continued)

(58) Field of Classification Search
CPC . B65D 81/32; B65D 81/3205; B65D 81/3011; B65D 81/325; B65D 83/0005; B65D 83/0033;B65D 83/005; B05C 17/00553; B05C 17/01; B01F 5/0615; B01F 13/0023; B01F 15/0087
(Continued)

(56) References Cited

U.S. PATENT DOCUMENTS 3,323,682 A 6/1967 Creighton
3,815,791 A * 6/1974 Clark ..... G01F 11/026 222/326
(Continued)

FOREIGN PATENT DOCUMENTS

CN 1615384 A 5/2005
CN 101124127 A 2/2008
(Continued)

OTHER PUBLICATIONS

International Search Report for International Patent Application No. PCT/EP2012/066192 mailed on Feb. 4, 2013.
(Continued)

*Primary Examiner* — J. Casimer Jacyna
*Assistant Examiner* — Benjamin R Shaw
(74) *Attorney, Agent, or Firm* — Global IP Counselors, LLP

(57) ABSTRACT

A cartridge is provided having at least one reception chamber (2), which extends in the longitudinal direction, for a medium to be dispensed, having a head part (4), a base part (6) and a cartridge wall (3) which bound the reception chamber (2), with the head part (4) having an outlet (5) for the medium. The cartridge wall (3) is designed as a film (3), the head part (4) and the base part (6) in each case as fixed shape parts and the head part (4) is sealingly and non-releasably connected to the cartridge wall (3). A multicomponent cartridge is furthermore provided by the invention.

21 Claims, 13 Drawing Sheets

Figure 1:
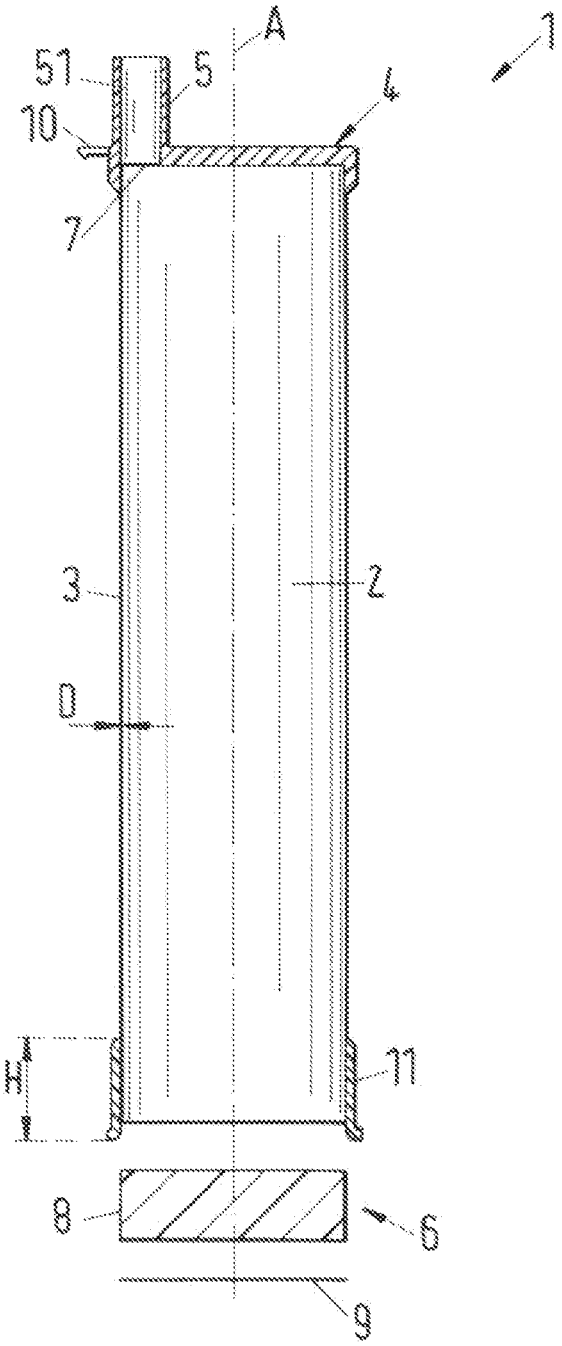

(51) Int. Cl.

| | |
|---|---|
| ***B05C 17/005*** | (2006.01) |
| ***B05C 17/01*** | (2006.01) |
| ***B01F 5/06*** | (2006.01) |
| ***B01F 13/00*** | (2006.01) |
| ***B01F 15/00*** | (2006.01) |
| ***B65D 81/32*** | (2006.01) |
| ***B65D 83/00*** | (2006.01) |

(52) U.S. Cl.
CPC .... *B01F 15/0087* (2013.01); *B05C 17/00553* (2013.01); *B05C 17/00583* (2013.01); *B05C 17/01* (2013.01); *B65D 81/325* (2013.01); *B65D 83/005* (2013.01)

(58) Field of Classification Search
USPC ..... 222/137, 135, 145.1, 145.5, 252, 325, 222/326, 330
See application file for complete search history.

(56) References Cited

U.S. PATENT DOCUMENTS

| | | | | |
|---|---|---|---|---|
| 5,501,368 | A * | 3/1996 | Brandhorst | B05C 17/00583 222/326 |
| 5,593,066 | A * | 1/1997 | Konuma | B05C 17/00506 222/105 |
| 5,667,102 | A * | 9/1997 | Keller | B05C 17/00513 222/327 |
| 5,875,928 | A * | 3/1999 | Muller | A61O 5/064 222/137 |
| 6,129,244 | A * | 10/2000 | Horth | A61O 5/064 222/105 |
| 6,158,621 | A | 12/2000 | Keller | |
| 6,299,022 | B1 * | 10/2001 | Bublewitz | B05C 17/00506 222/105 |
| 6,352,177 | B1 * | 3/2002 | Bublewitz | A61O 5/064 222/137 |
| 6,796,460 | B2 * | 9/2004 | Ichikawa | B05C 17/01 222/105 |
| 2002/0170926 | A1 * | 11/2002 | Horner | B05C 17/00513 222/137 |
| 2003/0136859 | A1 | 7/2003 | Borden et al. | |
| 2006/0091157 | A1 * | 5/2006 | Nomula | B05C 17/01 222/326 |
| 2008/0029542 | A1 * | 2/2008 | Keller | B05C 17/00509 222/145.5 |
| 2008/0156831 | A1 * | 7/2008 | Nakayama | B32B 15/08 222/327 |
| 2008/0173673 | A1 * | 7/2008 | Muller-Paul | A61O 5/062 222/137 |
| 2008/0251535 | A1 * | 10/2008 | Suchan | A61O 5/064 222/83 |
| 2009/0122123 | A1 * | 5/2009 | Ostermeier | B65D 81/325 347/86 |
| 2009/0134186 | A1 | 5/2009 | Keller | |
| 2009/0152300 | A1 * | 6/2009 | Hayman | A61O 5/062 222/145.6 |
| 2010/0012210 | A1 * | 1/2010 | Miyano | A61O 5/064 137/896 |
| 2010/0108709 | A1 | 5/2010 | Frey | |
| 2013/0265846 | A1 * | 10/2013 | Bublewitz | A61M 5/31596 366/177.1 |
| 2014/0158711 | A1 * | 6/2014 | Peuker | A61C 5/064 222/80 |

FOREIGN PATENT DOCUMENTS

| | | | |
|---|---|---|---|
| CN | 101394937 | A | 3/2009 |
| EP | 0 721 805 | A2 | 7/1996 |
| GB | 1 029 489 | | 5/1966 |
| GR | 1 118 419 | | 7/1968 |
| JP | 07 256178 | A | 9/1995 |
| JP | H0985145 | A | 3/1997 |
| JP | 2003040360 | A | 2/2003 |
| JP | 2009254936 | A | 11/2009 |
| JP | 2010512996 | A | 4/2010 |
| WO | 2008076941 | A1 | 6/2008 |

OTHER PUBLICATIONS

Written Opinion for International Patent Application No. PCT/EP2012/066192 mailed on Feb. 4, 2013.
International Preliminary Report of Patentability from the International Bureau mailed on May 1, 2014.
Japanese Office Action issued May 24, 2016 in JP Patent Application No. 2014-536155 (with English Translation).

* cited by examiner 100
70
72
71
73
5
4
7
74
1

CARTRIDGE AND MULTICOMPONENT CARTRIDGE

PRIORITY CLAIM

The present application is a National Stage of International Application No. PCT/EP2012/066192, filed on Aug. 20, 2012, which claims priority to European Patent Application No. 1118538.4 filed on Oct. 17, 2011, the entire contents of which are being incorporated herein by reference.

The invention relates to a cartridge having at least one reception chamber, which extends in the longitudinal direction, for a medium to be dispensed as well as to a multicomponent cartridge in accordance with the preamble of the respective independent claim.

In the industrial sector, in the construction industry, for example of buildings, and also in the dental sector, cartridges are frequently used to store liquid flowable substances, frequently pasty or viscous to highly viscous substances, and to dispense them for the respective application as required. Examples for such substances are caulking compounds, compounds for chemical dowels or chemical anchors, adhesives, pastes or impression materials in the dental sector. These cartridges are usually produced from plastic and are manufactured in an injection molding process.

A distinction is made between single-component systems in which the material to be dispensed is only made of one component and two-component or multicomponent systems in which at least two different components are stored in separate chambers of the same cartridge or in separate cartridges, wherein the components are intimately mixed on dispensing by means of a dynamic or static mixing apparatus. Examples for this are two-component adhesives or chemical dowels which only harden after the mixing of the two components. Two-component systems are in particular also used in the industrial sector for paints which are often used to generate functional protective layers such as for corrosion protection.

It is frequently the case that the cartridges include one (or more) axially displaceable conveying pistons by whose movement the material is dispensed from the chamber or chambers. It is understood that the chambers have to have sufficiently thick walls in order to be able to withstand the pressure arising on the dispensing. In addition, the cartridges have to have sufficiently substantial wall thicknesses to be sufficiently diffusion-resistant. This is in particular important with respect to the storage to prevent a diffusing in or a diffusing out of the chemical substances and thus a degradation of the cartridge content as effectively as possible. Since such plastic cartridges are as a rule only designed for a single use, a substantial amount of waste results both with regard to volume and to mass, which is in particular also disadvantageous under aspects of environmental protection.

A known alternative to the plastic cartridges is represented by hoses in which the respective materials are stored. These hoses are then placed into special supporting apparatus or dispensing apparatus to dispense their contents for the respective application. Such hoses are admittedly in particular much more favorable than cartridges from a waste volume aspect, but they have other disadvantages. Much more complex filling apparatus are required to fill and close the hoses. In addition, their storage is more problematic since hoses are not able to stand so that special measures or packaging have to be provided for the storage. Problems with the leak tightness of such hoses can also occur. In addition, the material of the residual volume in the hose which cannot be dispensed is relatively high. Hoses furthermore have the disadvantage that they are very sensitive toward mechanical influences, in particular toward sharp edges or pointed corners.

In addition to the aspect of environmental protection, the topic of sustainability is also increasingly gaining importance. The use of renewable starting materials, the minimization of the use of raw materials and energy as well as a reduction of waste which is as high as possible are increasingly gaining importance both with regard to the cartridge per se and to the volume of residual material remaining in the cartridge.

It is therefore an object of the invention to provide a cartridge which represents an improvement, in particular also with respect to its waste volume and its waste amount, with regard to sustainability and environmental protection. A high operational security and a good storability of the cartridge should be ensured in this respect. Furthermore, a corresponding multicomponent cartridge or multicomponent application should be made possible by the invention.

The subjects of the invention satisfying this object are characterized by the features of the independent claims of the respective category.

In accordance with the invention, a cartridge is therefore proposed having at least one reception chamber, which extends in the longitudinal direction, for a medium to be dispensed, having a head part, a base part and a cartridge wall which bound the reception chamber, with the head part also having an outlet for the medium. The cartridge wall is designed as a film, the head part and the base part in each case as fixed shape parts and the head part is sealingly and non-releasably connected to the cartridge wall.

The cartridge in accordance with the invention provides the advantages of a conventional cartridge with respect to its filling and its storability thanks to the fixed shape head part and base part; it therefore does not have to be filled in complex and/or expensive filling apparatus as is as a rule necessary for hoses and can be stored substantially more easily, for example also standing. The design of the cartridge wall as a film means a very substantial reduction of waste and a reduction of the raw materials required for the manufacture in comparison with conventional cartridges. In addition, the design of the cartridge wall as a film brings about a very high flexibility with respect to the material selection. The film can be adapted to the specific cartridge content in dependence on the application. The film moreover represents a very efficient diffusion barrier so that no concessions have to be made with respect to the storability or the maximum storage time despite the greatly reduced wall thickness in comparison with cartridges known today. The cartridge contents are even effectively protected against the diffusing in or out of substances or a "degassing" with longer storage times. The cartridge in accordance with the invention is preferably placed into a reusable supporting cartridge on the dispensing of its contents so that the cartridge wall withstands the mechanical strains on dispensing.

A protective film is preferably provided at the end of the reception chamber bounded by the head part and sealingly closes the reception chamber at this end. The cartridge contents are also protected against diffusion processes through the end side or the head part by this measure.

It has proved itself in practice if the cartridge wall has a wall thickness of at most 0.3 mm, preferably of approximately 0.1 mm. The thinner the cartridge wall is in design, the smaller the raw material requirements for the manufacture of the cartridge and the waste amount after the emptying of the cartridge.

A particularly advantageous measure is that the film forming the cartridge wall is designed as a multilayer system. It is namely hereby possible to adapt the film ideally to the respective application. The properties of the film serving as a barrier can be used in a targeted manner to make them as efficient as possible with respect to the medium in the reception chamber. Such a multilayer system is preferably designed as a composite film. The multilayer system can also include metallic layers.

In a preferred embodiment, connection means are provided at the cartridge by means of which the cartridge can be connected to a second cartridge. These connection means can in particular be designed as a latch connection or a click connection or snap-in connection. The connection means are preferably arranged so that the two cartridges can be connected side by side next to one another so that their longitudinal directions or longitudinal axes extend parallel to one another. The possibility of connecting a plurality of cartridges to one another via the connection means considerably increases the flexibility with respect to the areas of application because the cartridges can in particular be used very easily for multicomponent systems.

In a preferred embodiment, the base part includes a piston which can be introduced into the reception chamber at the end remote from the head part and is sealingly displaceable along the cartridge wall in the longitudinal direction. The use of a piston in the reception chamber for dispensing the medium has the advantage that as a rule smaller residual material volumes remain in the cartridge, whereby the amount of waste is reduced. Furthermore, with chemical media in the reception chamber, the risks caused by chemistry are minimized. The piston is preferably designed as a valve piston so that a simple bleeding during the insertion of the piston is possible.

A further advantageous measure is that a fixed shape supporting ring is provided which surrounds the cartridge wall from the outside at the end of the reception chamber intended for the reception of the piston. This supporting ring is in particular advantageous with respect to the storage since it improves the seal between the cartridge wall and the piston.

A sealingly closing end film is preferably provided at the base part. In combination with the protective film provided in the region of the head part and the cartridge wall designed as a film, the medium in the cartridge is then completely surrounded by film, i.e. is completely packed in film.

It is furthermore advantageous if the base part or the supporting ring is sealingly and non-releasably connected to the cartridge wall. A particularly reliable protection of the medium can hereby be realized, in particular during the storage. This connection can be realized, for example, in that the base part and the supporting ring are manufactured in an injection molding process in which the film forming the cartridge wall is partially overmolded with a liquid plastic. It is possible by this overmolding easily to partially melt or plasticize the film so that it subsequently enters into an intimate, non-releasable connection with the base part and/or with the supporting ring on the cooling and solidifying of the plastic. The connection between the head part and the cartridge wall can also be realized in an analog manner. It is naturally also possible to realize the connection between the head part or the base part and/or the supporting ring and the cartridge wall by a welding or adhesive bonding or clamping of the parts to one another. In such cases, the head part and the base part and the optional supporting ring are preferably each manufactured in an injection molding process and are welded or adhesively bonded or clamped to the film forming the cartridge wall in a subsequent processing step.

A multicomponent cartridge is furthermore provided by the invention having at least two cartridges in accordance with the invention, wherein the two cartridges are arranged next to one another with respect to the longitudinal direction. The area of application of the cartridge in accordance with the invention can be expanded to include two-component and multicomponent systems by this multicomponent cartridge.

The two cartridges are preferably fixedly coupled to one another via the connection means so that the multicomponent cartridge forms a unit capable of storage and dispensing.

It is a particularly advantageous measure if the outlets of the cartridges form a common connection piece or are designed for the reception of a common connection piece, wherein the connection piece is designed for cooperation with an accessory part, in particular with a closure part or with a mixer. It is, for example, possible in this manner to use accessory parts known per se in conjunction with the multicomponent cartridge. This compatibility is advantageous for practical and economic reasons.

To protect the contents of the dispensing chambers during the storage, it is advantageous in accordance with a preferred embodiment if the multicomponent cartridge has a closure part which is designed for cooperation with the connection piece and has two plugs of which each can engage into an outlet to close it.

To increase the flexibility of the multicomponent cartridge with respect to the areas of use and the applications, the reception chambers of the two cartridges can have different volumes so that in particular mixing ratios between the two media contained in the reception chambers of the cartridges can be realized which differ from the ratio of 1:1.

Further advantageous measures and embodiments of the invention result from the dependent claims.

Figure 2:
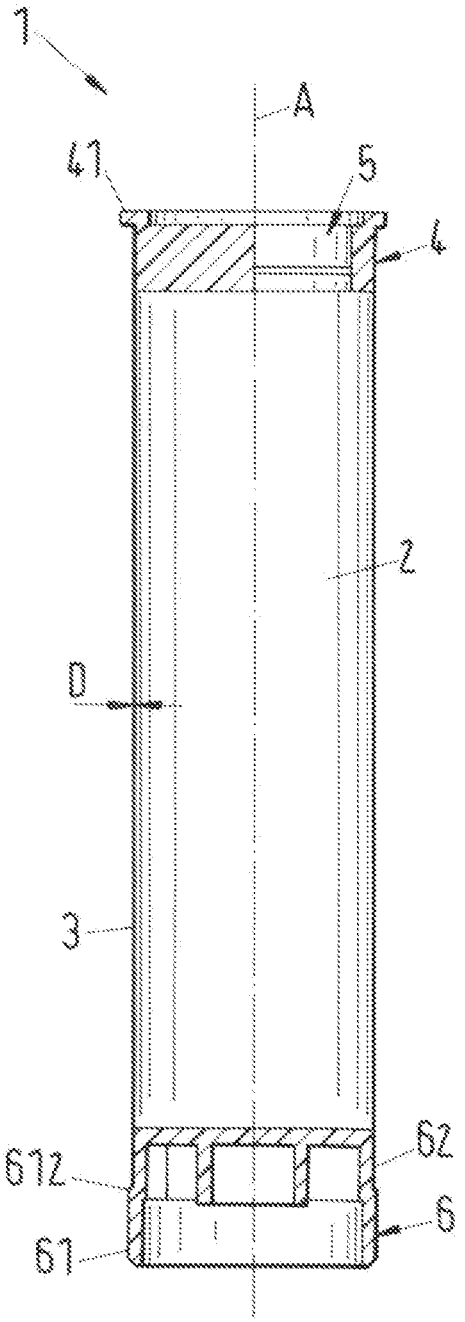
Figure 3:
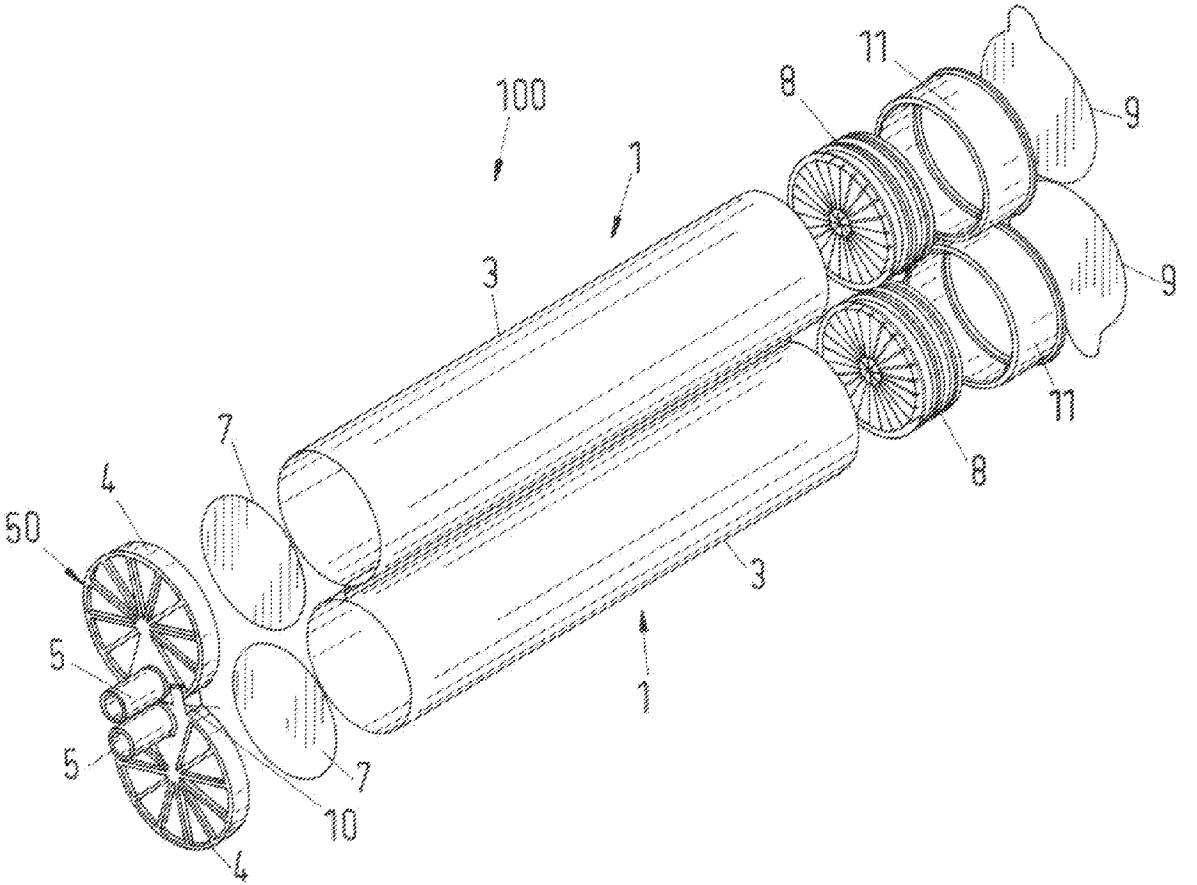
Figure 4:
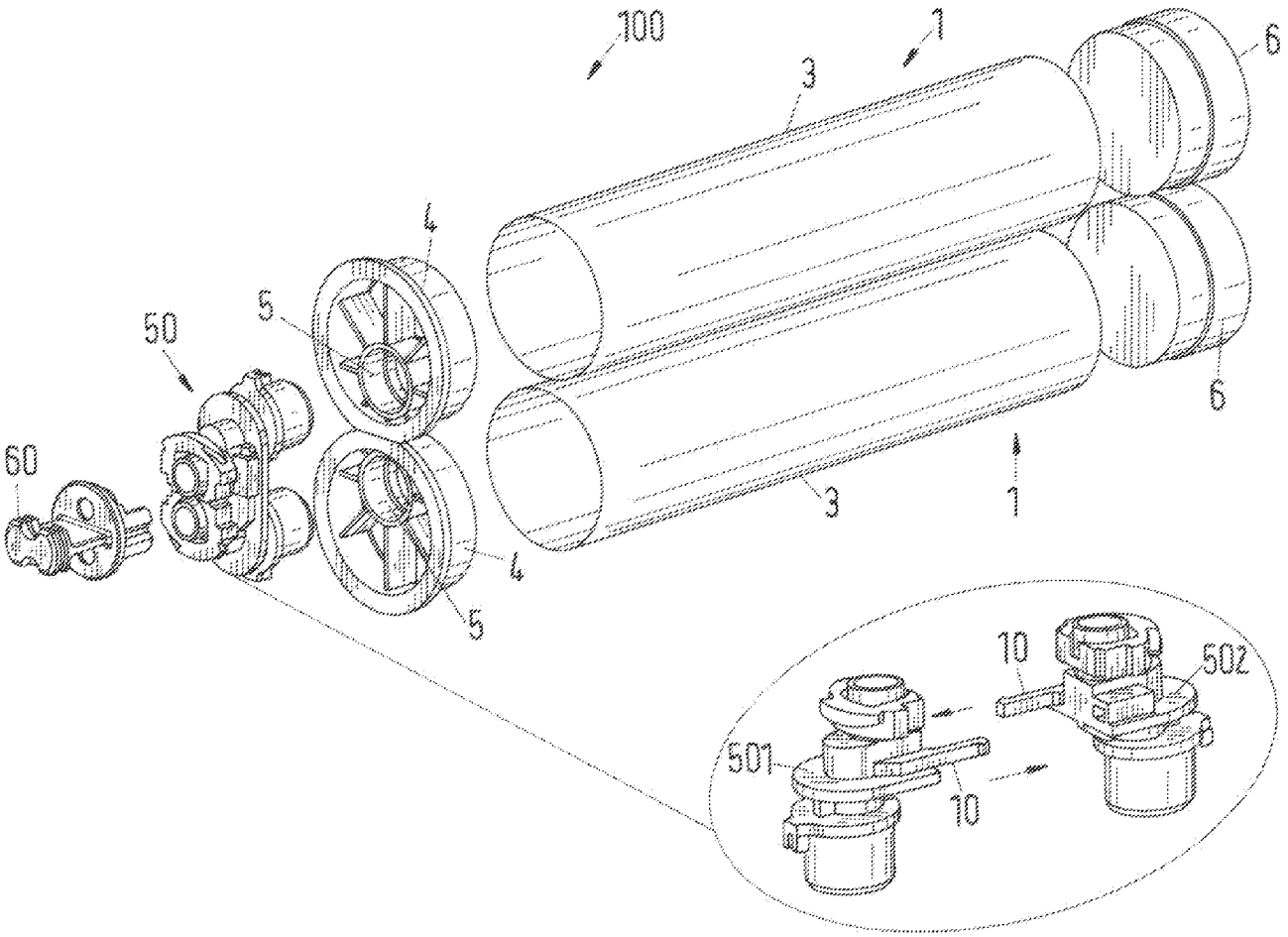
Figure 5:
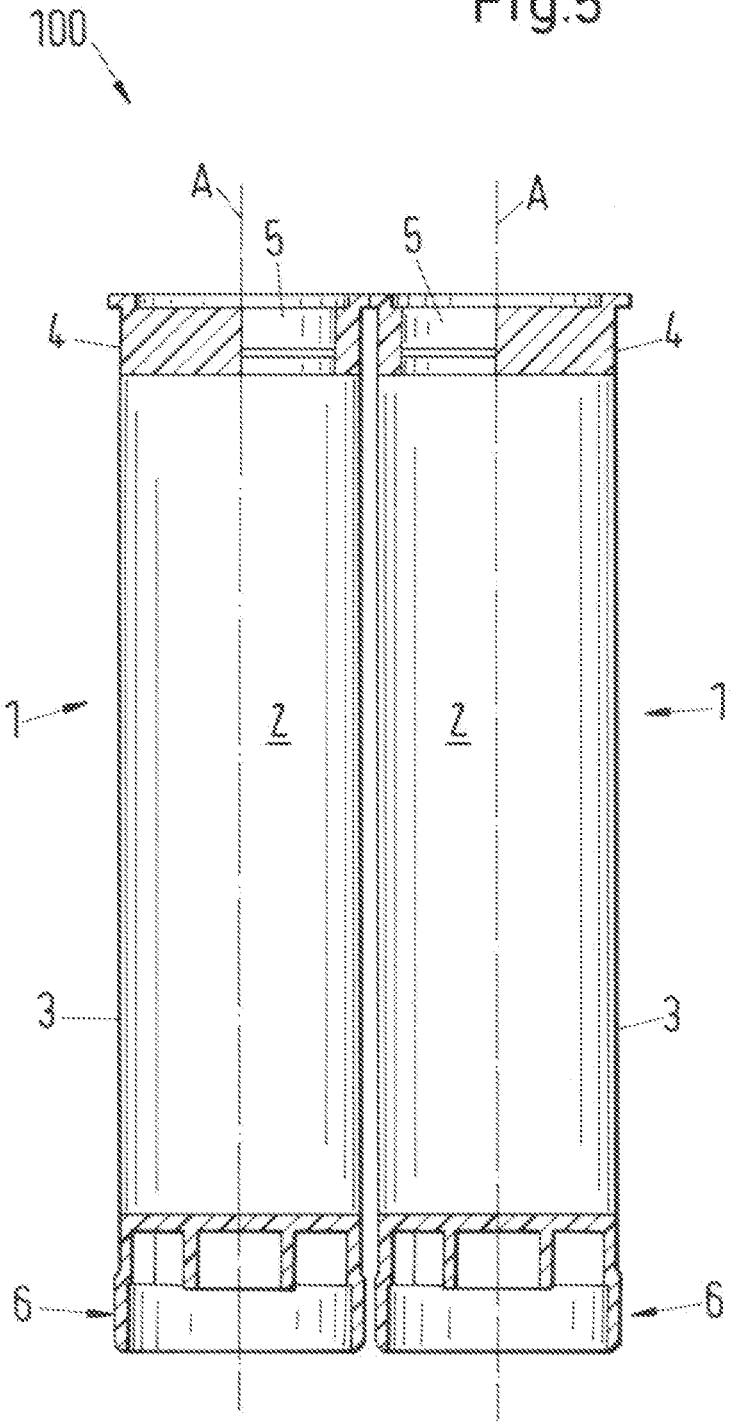
Figure 6:
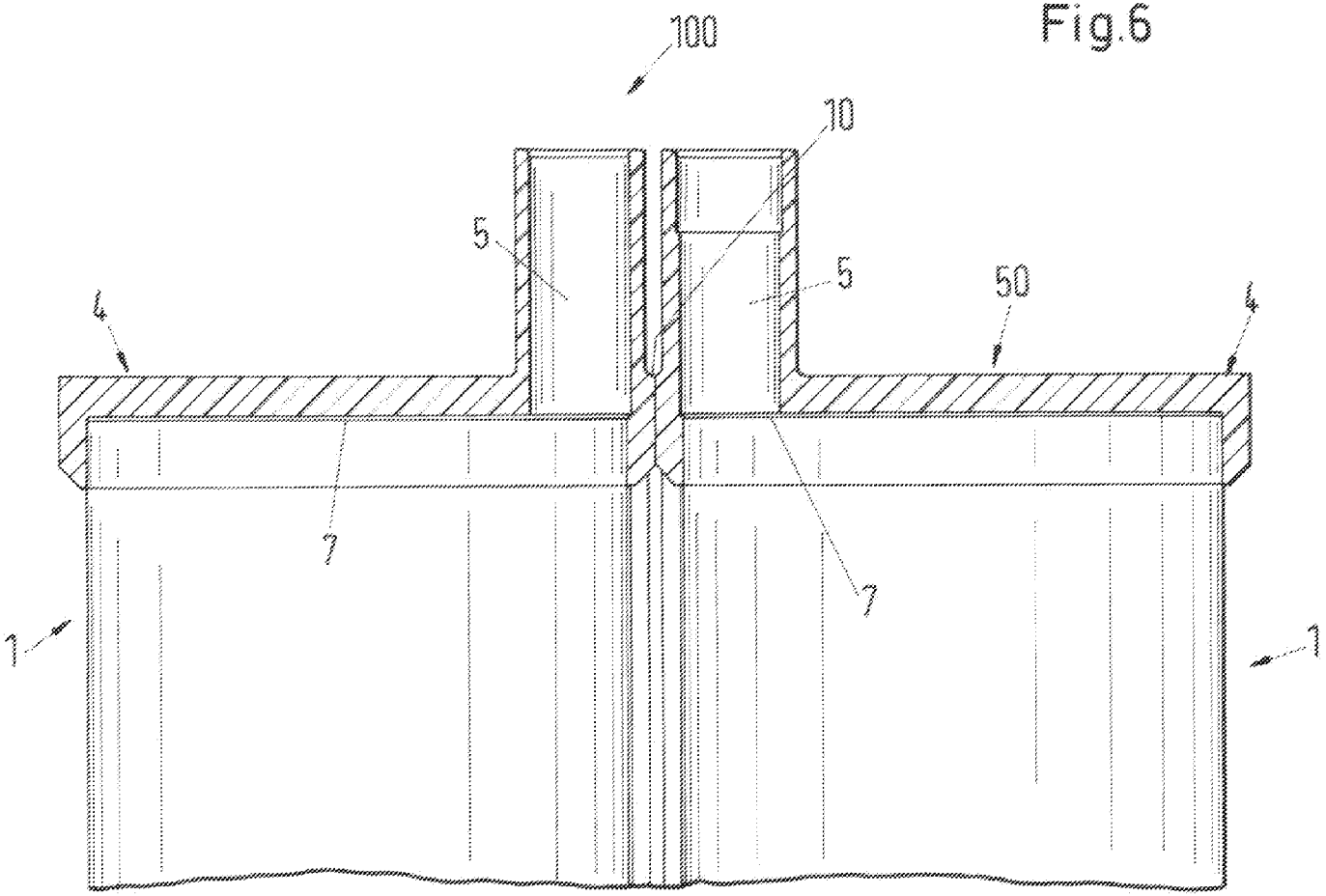
Figure 7:
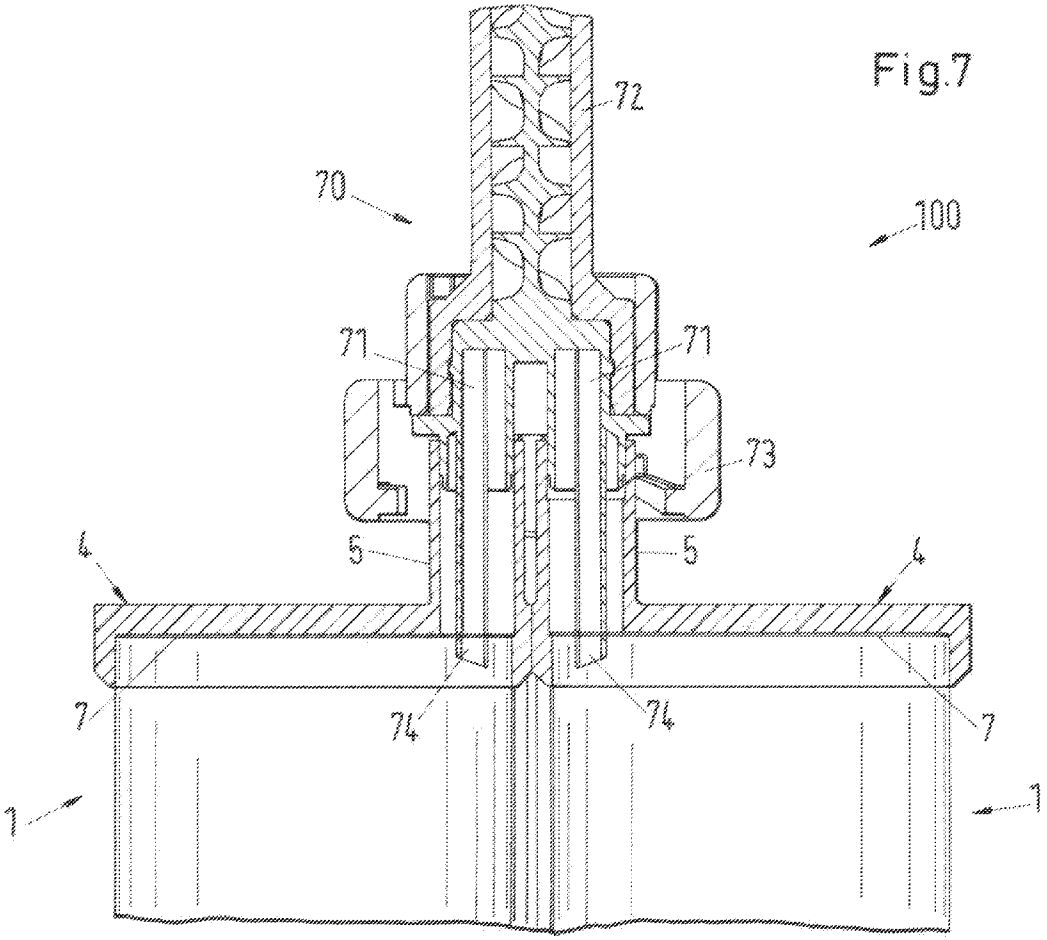
Figure 8:
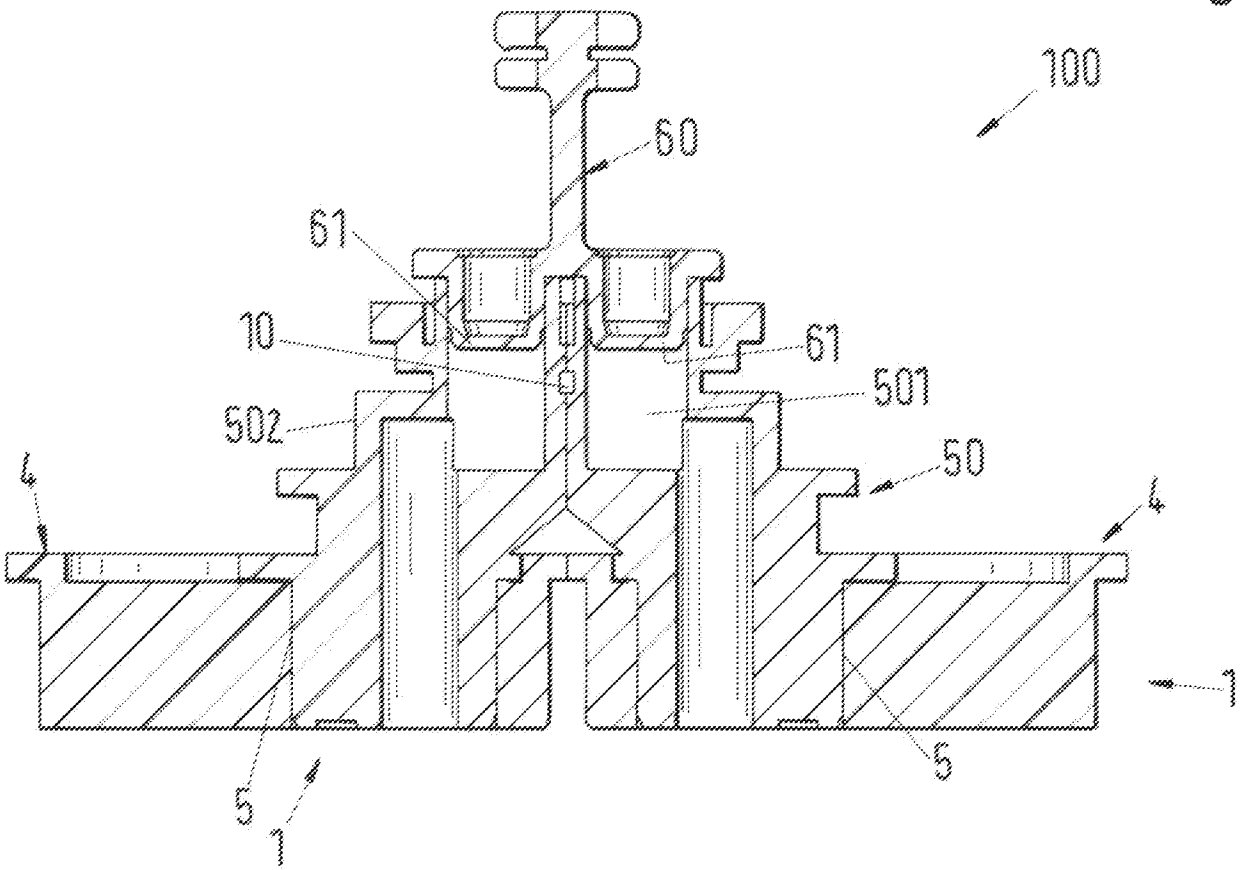
Figure 9:
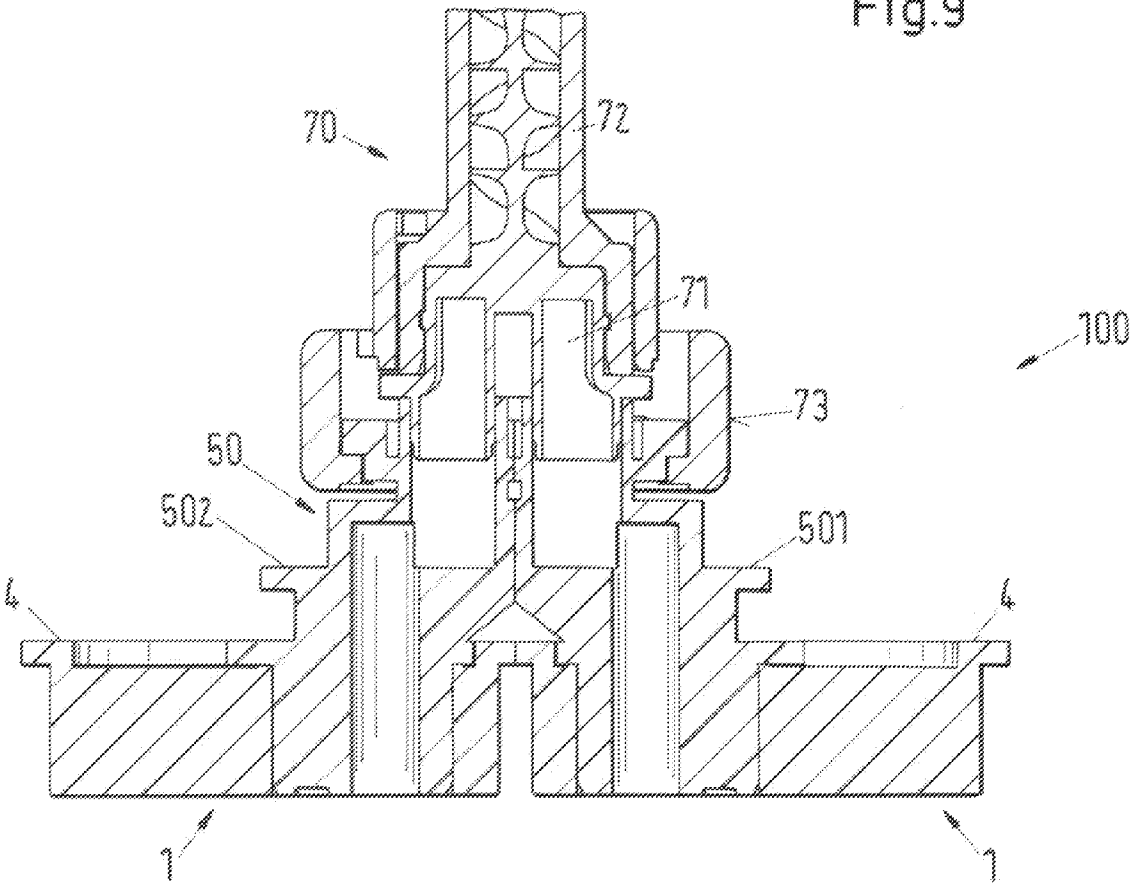
Figure 10:
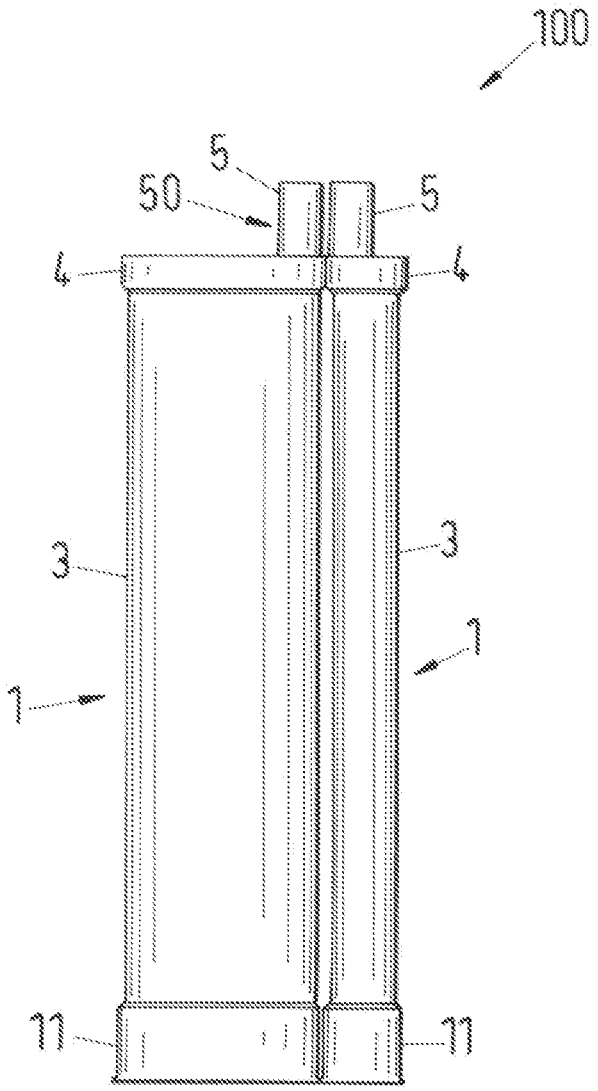
Figure 11:
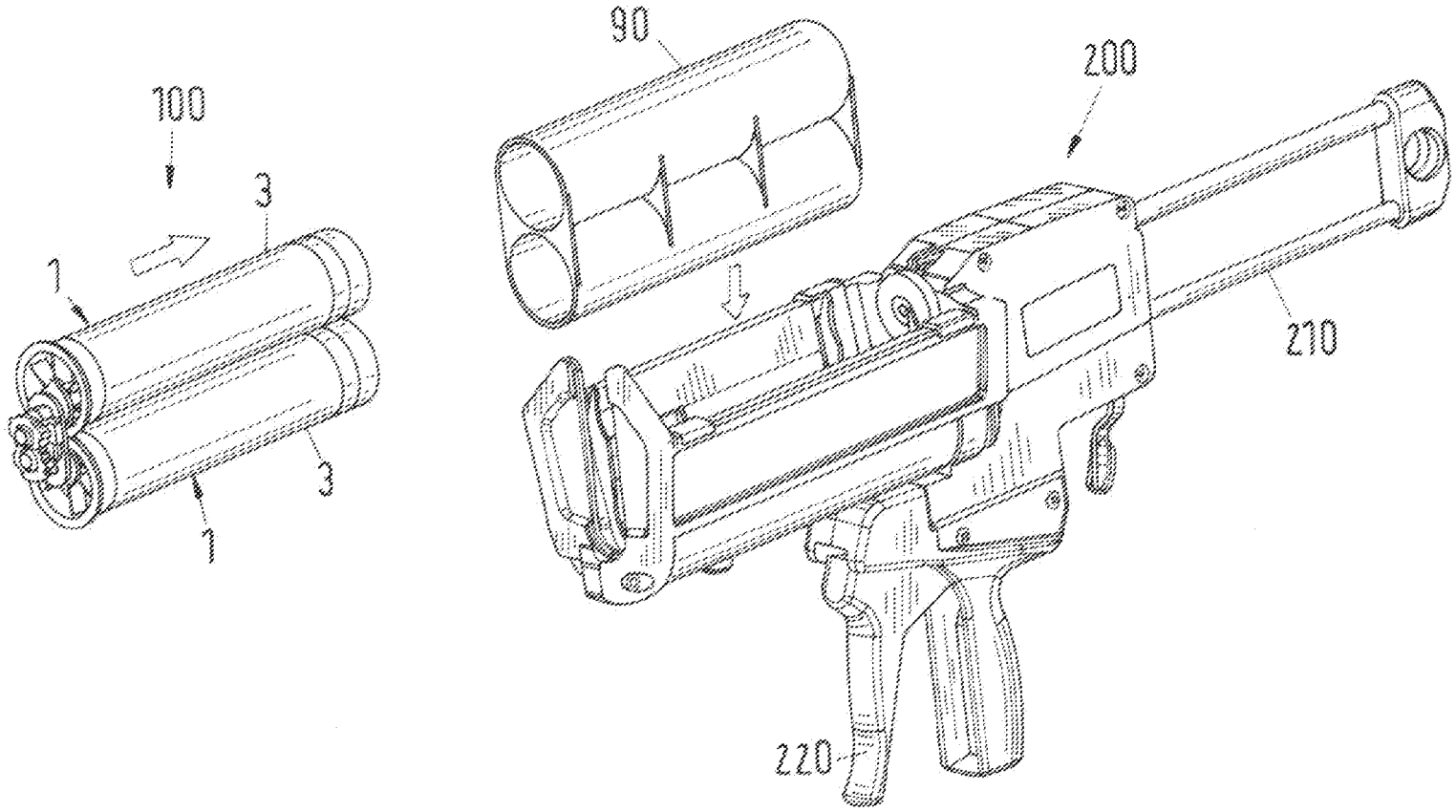
Figure 12:
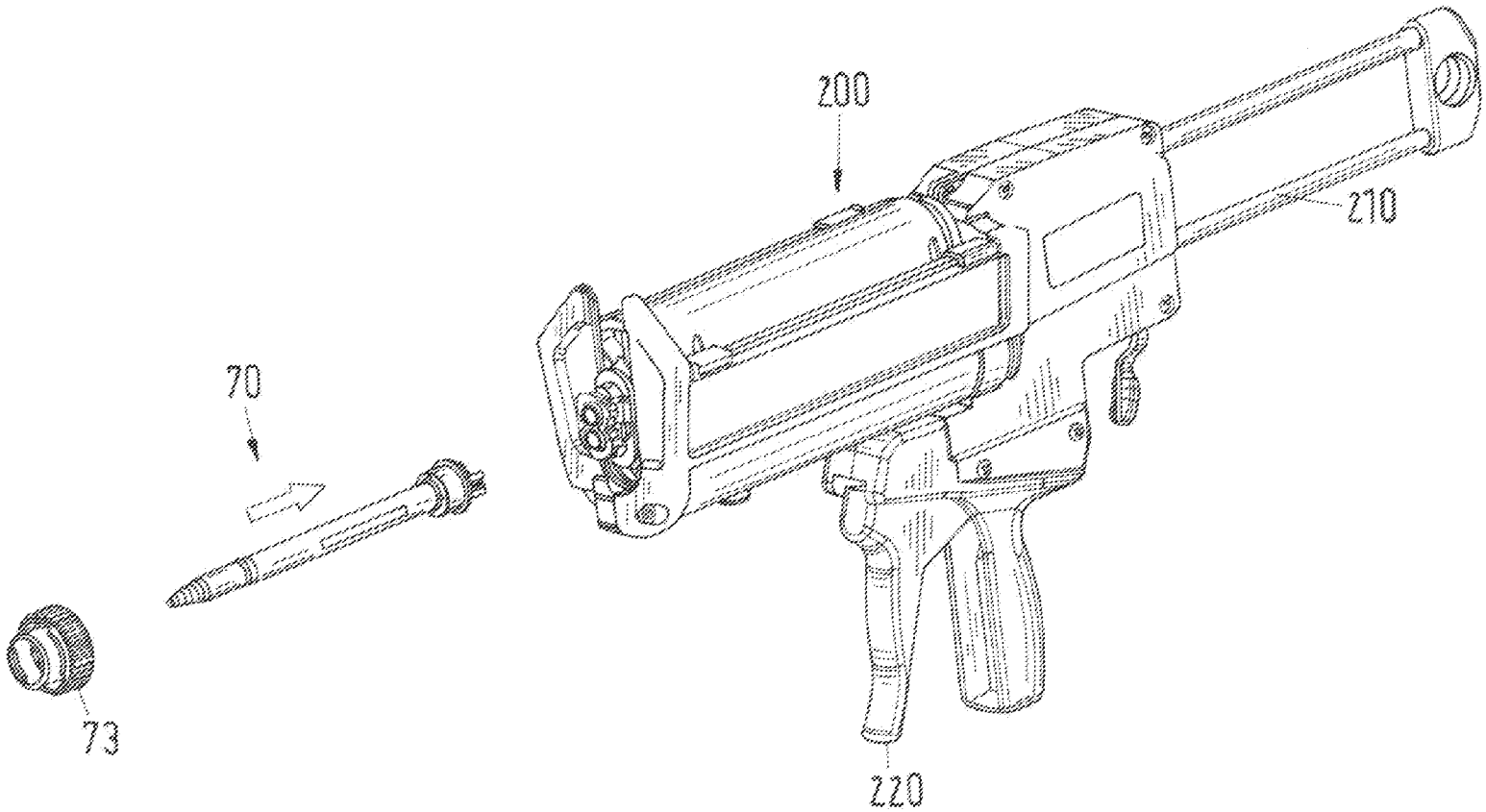
Figure 13:
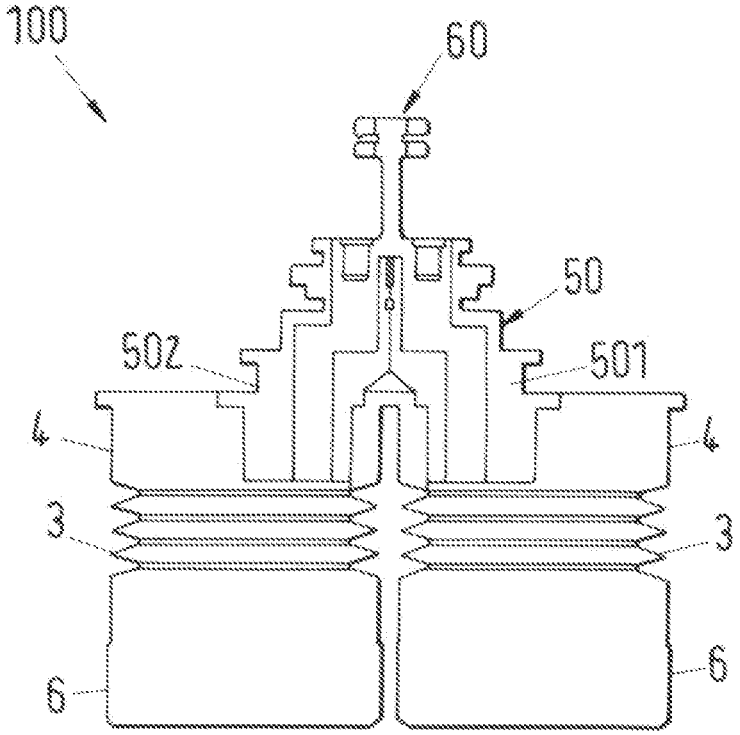

The invention will be explained in more detail in the following with reference to embodiments and to the drawing. There are shown in the schematic drawing, partly in section:

FIG. 1: a first embodiment of a cartridge in accordance with the invention in a longitudinal section;

FIG. 2: a second embodiment of a cartridge in accordance with the invention in a longitudinal section;

FIG. 3: a perspective exploded representation of a first embodiment of a multicomponent cartridge in accordance with the invention;

FIG. 4: a perspective exploded representation of a second embodiment of a multicomponent cartridge in accordance with the invention;

FIG. 5: the second embodiment of the multicomponent cartridge in accordance with the invention in a longitudinal section;

FIG. 6: a representation of the outlets of the first embodiment;

FIG. 7: a representation of the outlets of the first embodiment with a mixer placed on (only shown in part);

FIG. 8: a representation of the outlets of the second embodiment with an inserted connection piece and an inserted closure part;

FIG. 9: a representation of the outlets of the second embodiment with an inserted connection piece and mixer placed on (only shown in part);

FIG. 10: a view of a third embodiment of a multicomponent cartridge in accordance with the invention;

FIGS. 11-12: representations of a dispensing apparatus which is suitable for the cartridge in accordance with the invention and for the multicomponent cartridge in accordance with the invention; and FIG. 13: the second embodiment of the multicomponent cartridge in accordance with the invention in the emptied state.

FIG. 1 shows in a longitudinal section a first embodiment of a cartridge in accordance with the invention which is designated as a whole by the reference numeral 1. The cartridge 1 includes a reception chamber 2, which extends in the longitudinal direction, for a medium to be dispensed. The longitudinal direction is defined by the longitudinal axis of the cartridge 1 designated by A. The reception chamber 2 is bounded by a cartridge wall 3, a head part 4 and a base part 6. The base part 6 in this embodiment includes a piston 8 which is not yet inserted into the reception chamber 2 in FIG. 1, but is rather shown outside thereof.

The reception chamber 2 of the cartridge 1 is cylindrical in design, that is the cartridge wall 3 is the jacket surface of a cylinder. The head part 4 of the cartridge 1 has an outlet 5 having an outlet passage 51 for the medium through which the medium can be dispensed from the reception chamber 2. The outlet 5 is here molded onto the head part 4 as a protruding tube. The head part 4 with the outlet 5 is injection molded in one piece, that is it is manufactured in its entirety in a single injection molding process, usually in one stage.

In accordance with the invention, the cartridge wall 3 is designed as a film 3 and the head part 4 and the base part 6 are each designed as fixed shape parts. The term film here means a very thin foil which is in particular made of plastic, metal or a combination of plastic and metal. Most films are not of fixed shape, that is they can be bent, crushed, folded or similar without any greater expenditure of force. In contrast to this, the head part 4 and the base part 6 are each designed as fixed shape parts, preferably plastic parts. It is meant by this that these parts do not change their shapes during normal use and can at most be elastically deformable without any substantial expenditure of force. Films are as a rule considerably thinner in comparison with the fixed shape parts. In particular those films 3 are preferred as a cartridge wall 3 for the cartridge in accordance with the invention which are at most 0.3 mm thick, in particular at most 0.2 mm thick, and preferably approximately 0.1 mm thick. That is, the wall thickness D of the cartridge wall 3 is preferably at most 0.3 mm and in particular approximately 0.1 mm. It must be mentioned for comparison that cartridges of plastic manufactured in an injection molding process and known today usually have a wall thickness of at least 1.5 to 3 mm.

The design of the base part 6 as a fixed shape part also has the advantage that the cartridge 1 is capable of standing; that is, it can be stored standing upright on the base part 6.

In accordance with the invention, the head part 4 is connected sealingly and non-releasably to the film 3 forming the cartridge wall. This connection can, for example—as will be explained further below—be realized in the injection molding process for the head part 4 in that the film 3 is partially overmolded with the liquid plastic which forms the head part 4 after its solidification. It is alternatively naturally also possible first to manufacture the head part 4 as a separate component which is subsequently welded or adhesively bonded or sealingly connected in another manner to the film 3.

In the first embodiment, a protective film 7 is provided at the end of the cartridge wall 3, which is adjacent to the head part 4, and sealingly closes 20 the reception chamber 2 at this end. Since the reception chamber 2 is designed as cylindrical, the protective film 7 has a circular design and closes or seals the reception chamber 2 at its end face facing the head part 4. The protective film 7 in particular also prevents the medium from being able to move out of the reception chamber 2 into the outlet passage 51.

The cartridge 1 can furthermore have connection means 10 by means of which the cartridge 1 can be connected to a second cartridge 1. In the embodiment described here, the connection means 10 are provided next to the outlet 5 at the head part 4 of the cartridge 1. The connection means 10 are preferably designed in a manner known per se as a click connection or as a snap-in connection or as a latching connection and are arranged so that two cartridges 1 are arranged side by side, that is with parallel longitudinal axes A, next to one another (see e.g. FIG. 3). Alternatively or additionally, connection means can naturally also be arranged along the cartridge wall 3 or at the base part 6.

The cartridge 1 or the reception chamber 2 is open at the end remote from the head part 4. In the first embodiment, a piston 8 is provided as the base part 6, said piston preferably being designed as a valve piston and being able to be introduced into the reception chamber 2 at the open end of the cartridge 1 remote from the head part 4. The piston 8 is designed and dimensioned so that it is sealingly displaceable in the longitudinal direction along the cartridge wall 3. For this purpose, the piston 8 can be designed in a manner known per se with sealing lips or sealing margins, not shown, which contact the cartridge wall 3 when the piston 8 is introduced into the reception chamber 2.

The piston 8 is manufactured separately from the cartridge 1, for example in an injection molding process and is usually only inserted after the filling of the reception chamber 2.

An advantageous measure is that the piston has a sealingly closing end film 9 at its surface remote from the reception chamber 2, that is that surface which forms the outer side of the base of the cartridge 1 after the insertion of the piston 8.

A fixed shape supporting ring 11 which surrounds the cartridge wall 3 over the full periphery from the outside is furthermore provided at the end of the cartridge wall 3 at which the base part 6 is arranged. The supporting ring 11 has an axial height H in the direction of the longitudinal axis A which substantially corresponds to the axial height of the piston 8. After the piston 8 has been inserted into the reception chamber 2, the supporting ring 11 supports the cartridge wall 3 in the region in which the piston 8 is located. A high sealing effect is hereby ensured between the cartridge wall 3 and the piston 8, in particular also during the storage of the filled cartridge 1.

The supporting ring 11 is sealingly and non-releasably connected to the cartridge wall 3. This can take place in a correspondingly similar manner as described further above for the head part 4, namely by partial overmolding of the film 3 forming the cartridge wall 3 in an injection molding process or by a separate adhesive bonding or welding of the supporting ring 11 and the film 3.

The cartridge wall 3 designed as a film 3 furthermore serves as a barrier or as a diffusion barrier which prevents the diffusing in or the diffusing out of substances. These substances can, for example, be chemical components of the medium contained in the reception chamber 2 or can be humidity or oxygen. The film 3 thus allows a particularly long storability of the cartridge 1 filled with a medium. Since the film 3 acts as a barrier layer or as a diffusion barrier, it is possible to design the cartridge wall 3 only as a film 3 and thus with a thickness D which is considerably smaller than with known cartridges.

The greatly reduced thickness D of the cartridge wall 3 in comparison with known cartridges has the advantageous effect that considerably less raw material is required for the manufacture of the cartridge 1 and that the amount of waste of the cartridge 1 usually designed for single use is considerably reduced with respect both to the volume and to the weight.

The second advantageous effect of the cartridge wall 3 designed as a film is that the film 3 reduces the friction between the piston 8 and the cartridge wall 3 in comparison with known cartridges. The piston 8 is moved in the direction of the longitudinal axis A during the application for dispensing the medium from the reception chamber 2 to convey the medium through the outlet passage 51. The film 3 in this respect allows an easier sliding of the piston 8.

The protective film 7 and the end film 9 have the advantage that the total reception space 2 of the cartridge 1 is surrounded by a barrier layer or a diffusion barrier by them; that is, the medium in the reception chamber 2 is completely surrounded by the films 3, 7, 9 or is enclosed by them, which is advantageous with respect to a particularly good storability. The films 3, 7, 9 can be—but do not have to be—designed as of the same type with respect to their thickness D and their composition. It is preferred for practical reasons if the films 3, 7, 9 each have a thickness of at most 0.2 mm, and preferably of approximately 0.1 mm.

Each of the films 3, 7, 9 can be ideally adapted to the respective application. Depending on the composition and on the type of the medium in the reception chamber 2, the films 3, 7, 9 can be designed so that they ensure an ideal storability and an ideal protection of the cartridge contents and of the head part 4.

It is a particularly preferred measure if in particular the film 3 forming the cartridge wall 3 is designed as a multilayer system, that is, for example, is formed from a plurality of films or layers placed over one another. These different layers of the film 3 can have different functions. A protective layer which is made of a medium not sensitive to the medium to be dispensed, for example polyamide (PA) or polybutylene terephthalate (PBT) can, for example, be on the side facing the reception chamber 2. This can optionally be adjoined by a barrier layer which prevents the exit or entrance of substances such as water, oxygen or VOCs (volatile organic compounds). A filler layer, which is made e.g. of recyclate, can then follow. Layers of a polyolefin such as PE or PP can also be provided, or metallic layers.

Additionally or alternatively, foamed films can also be provided as layers.

The protective film 7 and the end film 9 can also be designed in the same manner.

The cartridge in accordance with the invention can in particular be manufactured in an injection molding process. As generally usual, a tool is used in injection molding which includes cores and hollow spaces into which the liquid plastic is injected. The core moves into a correspondingly shaped counter-piece on the closing of the tool. After the closing of the tool, there is then a hollow space between the core and the counter-piece which is a negative copy of the part to be manufactured. The liquid plastic is injected into this hollow space and solidifies there. Subsequently the tool is opened and the injected part is demolded and ejected.

To sealingly connect the film 3 forming the cartridge wall and the head part 4 and/or the supporting ring 4, the film 3 can be applied to the jacket surface of that core which forms the side of the head part 4 facing the reception chamber or which forms the inner surface of the supporting ring 11.

After the closing of the tool, the film 3 is partially overmolded with the liquid plastic. In so doing, the film 3 easily partially melts or is plasticized due to the contact with the liquid plastic. A particularly intimate and non-releasable connection hereby arises between the cartridge wall 3 and the head part 4 or the supporting ring 11.

To manufacture the protective film 7, a film of circular disk shape is placed on the end face of the core which forms the side of the head part 4 facing the reception chamber 2 before the injection molding, said film then forming the protective film 7 in the finished cartridge. The film of circular disk shape is in this respect preferably dimensioned such that it projects over the margin of the end face of the core. If the liquid plastic is then injected after the closing of the tool, it bends that part of the film of circular disk shape which projects over the margin of the end face of the core. The film 7 of circular disk shape is hereby intimately connected to the film 3 so that a leak tight and fixed connection is present between the cartridge wall 3 and the protective film 7 in the finished cartridge 1.

It is naturally important that the films 3 and 7 adhere to the core for so long until they are overmolded with plastic. This adhesion can be realized in different manners, for example electrostatically or by generating an underpressure by corresponding suction openings in the core.

All plastics known per se used for cartridges, for example, polyamides (PA), polypropylene (PP), polyethylene (PE), polybutylene terepththalate (PBT) or polyolefins in general, are suitable for the manufacture of the head part 4, of the base part 6 and of the supporting ring 11.

The cartridge 1 is first manufactured without the piston 8 in an injection molding process and is then closed by the protective film 7—and optionally other closure means—at its outlet 5. The medium is then filled into the reception chamber 2 from the still open end of the reception chamber 2 at the bottom in accordance with the representation. Subsequently, the piston 8, which is optionally provided with the end film 9, is inserted into the reception chamber 2 and then forms the chamber base which sealingly closes the reception chamber 2. The piston 8 is frequently designed as a valve piston so that, on the insertion of the piston 8, the air which may be present between the medium and the piston can be removed in a simple manner.

FIG. 2 shows a second embodiment of a cartridge 1 in accordance with the invention in a longitudinal section. Only the differences from the first embodiment will be looked at in the following. The explanations given in connection with the first embodiment also apply in accordingly the same manner to the second embodiment. Parts which are the same or which are equivalent in function are in particular provided with the same reference numerals.

One major difference is that no piston is provided in the second embodiment of the cartridge 1 in accordance with the invention, but rather the fixed shape base part 6 is non-releasably and sealingly connected to the cartridge wall 3. The one-piece base part 6 has two sections which are each substantially cylindrical in their outer shape, namely an upper region 62 which engages into the reception chamber 2 and thus represents the boundary of the reception chamber 2 at the base side as well as a base region 61 which is no longer engaged around by the cartridge wall 3 designed as a film. The cartridge wall 3 consequently extends with respect to the longitudinal direction up to an edge 612 at which the upper region 62 and the base region 61 are adjacent to one another. This cartridge 1 is naturally also able to stand on the base region 61 of the fixed shape base part 6. The base part 6 is here also preferably an injection molded plastic part, with the explanations of the first embodiment in this respect applying to the materials.

It is naturally also possible that the base region 61 projects outwardly beyond the cartridge wall 3. The film 3 serving as the cartridge wall is thereby surrounded by both sides.

Unlike the first embodiment provided with the piston 8, the second embodiment is designed as a collapsible cartridge 1; that is, the cartridge 1 is pushed together or collapsed with respect to the longitudinal direction on the dispensing of the medium from the reception chamber. This will be explained further below.

The fixed shape head part 4 in this second embodiment is partly inwardly arranged with respect to the cylindrical cartridge wall 3, that is the film 3 forming the cartridge wall lies outwardly on the head part 4 and is sealingly and non-releasably connected to the head part.

Designs are naturally also possible here in which the cartridge wall 3 is surrounded by the head part 4 on both sides, that is from the inside and from the outside.

The head part 4 has a collar 41 at its upper end in accordance with the representation up to which the cartridge wall 3 extends. The outlet 5 is designed as a substantially cylindrical opening in the head part 4. As will be explained further below (see e.g. FIG. 4), the outlet 5 in the second embodiment serves for the reception of an adapter 501 or 502 (FIG. 4) which is designed for cooperating with an accessory part, for example with a closure part or with a mixer.

The explanations with respect to the first embodiment apply in correspondingly the same manner with respect to the sealing, non-releasable connection between the cartridge wall 3 and the head part 4 or the base part 6. The film forming the cartridge wall 3 can thus, for example, be partially back-injected with the liquid plastic on the injection molding of the head part 4 and/or of the base part 6. Alternatively, it is also possible first to manufacture the head part 4 and the base part 6 by means of injection molding and then to weld or to adhesively bond the cooled plastic parts, namely the head part 4 and the base part 6, in each case with the film 3 forming the cartridge wall or to otherwise sealingly connect them together.

It is understood that individual features which were discussed in connection with the second embodiment can also be realized in a correspondingly similar manner in the first embodiment and vice versa. The head part 4 can thus also be designed partly inwardly disposed with respect to the cartridge wall 3 in the first embodiment, for example.

FIG. 3 shows a perspective representation of a first embodiment of a multicomponent cartridge in accordance with the invention which is designated as a whole by the reference numeral 100. The multicomponent cartridge includes at least two cartridges 1 of which each is designed in accordance with the invention. FIG. 4 shows a perspective representation of a second embodiment of a multicomponent cartridge in accordance with the invention which is likewise designated as a whole by the reference numeral 100. The second embodiment of the multicomponent cartridge 100 in accordance with the invention is shown in a longitudinal section in FIG. 5.

The first embodiment of the multicomponent cartridge 100 in accordance with the invention includes two cartridges 1 of which each is designed in accordance with the first embodiment of the cartridge 1 in accordance with the invention shown in FIG. 1. The second embodiment of the multicomponent cartridge 100 in accordance with the invention includes two cartridges 1 of which each is designed in accordance with the second embodiment of the cartridge 1 in accordance with the invention shown in FIG. 2.

In the following, reference will be made with an exemplary character to the case of special importance for practice that the multicomponent cartridge 100 is a two-component cartridge which includes exactly two cartridges 1. It is, however, understood that the invention is not restricted to such cases, but that the multicomponent cartridge can also include three or more cartridges.

The two cartridges 1 of the multicomponent cartridge 100 are arranged side by side next to one another so that their longitudinal axes A (see FIG. 1 and FIG. 2) extend parallel to one another.

The two cartridges 1 of the first embodiment (FIG. 3) are preferably fixedly connected to one another via the connection means 10. It is, however, also possible that the two head parts 4 and/or the two supporting rings 11 of the cartridges 1 are manufactured in a common injection molding process and are then fixedly connected to one another via elements which cannot be released non-destructively so that the two-component cartridge is in one piece with respect to the head parts 4 and/or the base parts 6.

A respective piston 8 is provided for each of the two cartridges 1 and is introduced into the reception chamber 2 after the filling of the respective reception chamber. The two outlets 5 of the cartridges 1 are arranged and designed such that they form a common connection piece 50 which includes the two separate outlets 5 and which is designed for cooperation with an accessory part.

FIG. 6 shows the connection piece 50 with the two outlets 5 in a larger representation. It is in principle not necessary to provide the two outlets 5 in the common connection piece 50 with a closure part because the respective medium in the reception chambers 2 is protected from diffusion processes and from running out by the protective films 7. It is understood that additional closure means may be provided, for example in correspondingly the same manner as will be described in connection with FIG. 8.

FIG. 7 shows the connection piece 50 or the outlets 5 with an accessory part, namely with a mixer 70. In this respect, it is a static mixer 70 for mixing the two media which are present in the respective reception chambers 2 of the two cartridges 1. The static mixer 70 includes in a manner known per se a mixer tube 72, only indicated in FIG. 7, with mixing elements (not shown) arranged therein. The mixer 70 furthermore includes two inlets 71 as well as one coupling piece 73. If the mixer 70 is placed onto the multicomponent cartridge 100, each of the separate inlets 71 engages into or over one of the outlet passages 51 so that the inlets 71 each form a flow connection with one of the outlets 5 and the respective medium moves from the respective reception chamber 2 through the respective outlet 5 into the mixer 70. The two media meet one another here and are mixed intimately with one another on passing through the mixer 70.

All types of connection known per se, in particular screw connections, snap-in connections or bayonet connections, are suitable for the connection of the mixer 70 to the connection piece 50 via the coupling piece 73.

If, as shown in FIG. 7, the cartridges 1 are provided with the protective film 7, it must be pierced or cut before the dispensing of the media. A number of possibilities are known to the skilled person for this purpose. A variant is that the inlets 71 of the mixer—or corresponding parts of another accessory part—are designed at their ends cooperating with the outlets 5, for example with an oblique edge 74 or a mandrel, such that the inlets 71 pierce the film 7 or open it in another manner on the placing on of the mixer 70.

In the second embodiment of the multicomponent cartridge 100 in accordance with the invention (FIG. 4 and FIG. 5), the outlets 5 of the cartridges 1 are designed for the reception of a common connection piece 50 (not shown in FIG. 5). The common connection piece 50 includes—as the detailed representation in FIG. 4 shows—two adapters 501 and 502 of which each is designed for engaging into one of the outlets 5 and so-to-say extends this outlet 5. The two adapters 501, 502 can be fixedly connected to one another via the connection means 10 and then form the common connection piece 50. As the detailed representation in FIG. 4 shows, the connection means 10 are designed as latch connections, with a respective bar-shaped latching element being provided at each of the adapters 501, 502 and engaging into a cut-out at the respective other adapter 502, 501, as the two arrows without reference symbols indicate. It is naturally also possible to manufacture the connection piece 50 in one piece so that the two adapters 501, 502 cannot be non-destructively separated from one another.

At the side remote from the outlets 5 of the cartridges 1, the connection piece 50 is designed to cooperate with an accessory part. This accessory part is a closure part 60 in FIG. 4 (not shown in FIG. 5).

FIG. 8 shows the connection piece 50 with the two outlets 5 in a larger representation. In FIG. 8, the closure part 60 is in operative connection with the connection piece 50 which includes the two adapters 501 and 502 which engage into the outlets 5 of the cartridge 1. It can be recognized that the closure part 60 has two plugs 61 of which each engages into one of the adapters 501, 502 and thus sealingly closes the outlets 5. The closure part 60 can thus be designed so that it is only connected to the connection piece 50 via the introduction of the plugs 61 into the adapters 501, 502. Securing means (not shown) can be provided to avoid an unintentional removal of the closure part 60, for example desired breaking points which are broken open or broken through by kinking off, turning or similar measures before the removal of the closure part. The securing means can also be designed as latching connections or snap-in connections. It is furthermore possible that the closure part 60 can be coupled to the connection piece 50 via a thread connection or a bayonet connection.

It is furthermore possible that the two adapters 501, 502 have a closure element directly molded on which is opened or removed before use by means of pulling off, cutting, breaking, turning or similar measures.

FIG. 9 shows the connection piece 50 or the adapters 501, 502 with another accessory part, namely with a mixer 70. In this respect, it is a static mixer 70 for mixing the two media which are present in the respective reception chambers 2 of the two cartridges 1. The static mixer 70 includes in a manner known per se a mixer tube 72, only indicated in FIG. 9, with mixing elements (not shown) arranged therein. The mixer 70 furthermore includes two inlets 71 as well as one coupling piece 73. If the mixer 70 is placed onto the multicomponent cartridge 100, each of the separate inlets 71 engages into or over one of the adapters 501, 502 so that the inlets 71 each form a flow connection with one of the outlets 5 and the respective medium moves from the respective reception chamber 2 through the respective outlet 5 into the mixer 70. The two media meet one another here and are mixed intimately with one another on passing through the mixer 70.

All types of connection known per se, in particular screw connections, snap-in connections or bayonet connections, are suitable for the connection of the mixer 70 to the connection piece 50 via the coupling piece 73.

FIG. 10 shows the view of a third embodiment of a multicomponent cartridge 100 in accordance with the invention. Only the differences from the first and second embodiments will be looked at in more detail in the following. The explanations which were made with respect to the first and second embodiments also apply in correspondingly the same manner to the third embodiment.

In the third embodiment, the multicomponent cartridge includes two cartridges 1, with the reception chambers 2 of the two cartridges 1 having different volumes. Such multicomponent cartridges 100 are intended for such two-component systems in which the two components should be mixed with one another in a volume ratio different from 1:1. In the multicomponent cartridge 100 shown in FIG. 10, the cartridge 1 at the left in accordance with the illustration has ten times the volume as the cartridge 1 at the right in accordance with the illustration. Other ratios are naturally also realizable, for example 2:1 or 4:1.

In the multicomponent cartridge 100 shown in FIG. 10, further connection means (not shown) can also be provided between the two cartridges 1, for example between the two supporting rings 11.

It is understood that the multicomponent cartridge in accordance with the second embodiment can also be designed in correspondingly the same manner for other mixing ratios than 1:1.

As already mentioned, the two-component or multicomponent cartridge 100 is preferably composed of two individual cartridges 1. The outlets 5 are—if necessary—closed by the closure part 60 or the protective films 7 close the outlets 5 before the filling of the cartridges 1. The respective media or components are then filled into the reception chambers 2 from the still open ends of the reception chambers remote from the head parts 4. Subsequently, a respective piston 8, optionally respectively provided with the third film 9, is inserted into the reception chambers 2 and then forms the respective chamber base and sealingly closes the reception chambers 2. The pistons 8 are frequently designed as valve pistons or as self-bleeding pistons so that the air present between the piston 8 and the medium can be let off on the introduction of the pistons 8. Once the multicomponent cartridge 100 has been filled, it can be stored, wherein the cartridge wall 3 and the optionally provided protection film or end film 7 or 9 respectively protect the cartridge contents from degassing or from other diffusion induced influences.

In the embodiment in accordance with FIG. 2 or FIG. 4, the filling preferably takes place from the head part 4 through the outlet 5 or outlets 5 which is/are then subsequently closed by means of the adapters 501, 502, for example. The collapsible cartridges are therefore preferably filled from the head part 4.

The use of the two-component or multicomponent cartridge 100 will now be explained with reference to FIGS. 11 and 12, with the explanations applies in correspondingly the same manner to all embodiments. To use the two-component cartridge 100, it is usually inserted into the holder of a dispensing apparatus (dispenser) 200. Since the multicomponent cartridge 100 is designed with thin cartridge walls 3 due to the film 3, a supporting cartridge 90 is preferably used for the dispensing so that the multicomponent cartridge 100 can withstand the mechanical strain on dispensing. Alternatively, the supporting function can also be integrated in the holder of the dispensing apparatus. The support cartridge 90 is designed for multiple use; it can be reused as often as desired. As is indicated by the arrow without reference symbol in FIG. 11, the multicomponent cartridge 100 is first introduced into the supporting cartridge 90 and is then inserted into the holder of the dispensing apparatus 200 together with it. The closure part 60—if present—is removed and a mixer 70 is fastened in its stead to the connection piece 50 (FIG. 12) by means of its connection piece 73, by a bayonet connection here. The dispensing apparatus 200 includes a double plunger 210 which can be moved forward by means of an activator 220. The double plunger 210 then, in the case of the first embodiment, exerts a force onto the two pistons 8 in the reception chambers 2, whereby they are displaced along the longitudinal axes A of the cartridges 1 and convey the respective medium through the respective outlet 5 into the static mixer 70. The two media (components) meet one another here and are mixed intimately with one another on passing through the mixer. If the multicomponent cartridge 100 in accordance with the second embodiment is designed as a collapsible multicomponent cartridge, the double plunger 210 exerts a force onto the two pistons acting as fixed shape base parts 6, whereby they are displaced along the longitudinal axes A of the cartridges 1 and in so doing collapse the cartridges 1 or the reception chambers 2 by pushing them together. The respective medium is conveyed through the respective outlet 5 into the static mixer 70 by the pushing together.

This collapsing of the cartridges 1 is illustrated for the second embodiment of the multicomponent cartridge 100 in accordance with the invention in FIG. 13, where a multicomponent cartridge in accordance with the second embodiment is shown in the emptied state. It can clearly be recognized how the cartridge walls 3 are each pushed together in the manner of a concertina between or over the shape fixed base part 6 and the fixed shape head part 4.

The invention claimed is:

1. A cartridge comprising:

at least one reception chamber extending in a longitudinal direction, and being configured to dispense a medium, the reception chamber having a head part, a base part and a cartridge wall bounding the reception chamber, the head part having an outlet for the medium, the cartridge wall being defined by a film and the head part and the base part being respective fixed shape parts, the head part being sealingly, non-releasably and integrally connected to the film that defines the cartridge wall; and a separate protective film at an end of the reception chamber that is bounded by the head part, the separate protective film being configured to sealingly close the reception chamber at the end of the reception chamber, and extending over the entire end of the reception chamber and up to the cartridge wall defined by the film.

2. The cartridge in accordance with claim 1, wherein the cartridge wall has a maximum wall thickness of 0.3 mm.

3. The cartridge in accordance with claim 1, wherein the film defining the cartridge wall is a multilayer system.

4. The cartridge in accordance with claim 3, further comprising a connection device configured to connect the cartridge to a second cartridge.

5. The cartridge in accordance with claim 1, wherein the base part includes a piston configured to be introduced into the reception chamber at an end remote from the head part and is sealingly displaceable along the cartridge wall in the longitudinal direction.

6. The cartridge in accordance with claim 5, further comprising a fixed shape supporting ring surrounding the cartridge wall at the end of the reception chamber configured to receive the piston from the outside.

7. The cartridge in accordance with claim 1, further comprising a sealingly closing end film disposed at the base part.

8. The cartridge in accordance with claim 6, wherein one of the base part and the supporting ring is sealingly and integrally connected to the cartridge wall.

9. A multicomponent cartridge comprising at least two cartridges, each cartridge being configured in accordance with the cartridge of claim 1, the two cartridges being arranged next to one another with respect to the longitudinal direction.

10. The multicomponent cartridge in accordance with claim 9, wherein the two cartridges are fixedly coupled to one another via a connection device.

11. The multicomponent cartridge in accordance with claim 9, wherein outlets of the cartridges are one of a common connection piece and being configured to receive the common connection piece, the connection piece being configured to cooperate with an accessory part.

12. The multicomponent cartridge in accordance with claim 11, further comprising a closure part configured to cooperate with the connection piece, the closure part having two plugs each of which are configured to engage into the outlet of one of the cartridges so as to close the outlet.

13. The multicomponent cartridge in accordance with claim 9, wherein the reception chambers of the two cartridges have different volumes.

14. The cartridge in accordance with claim 1, wherein the cartridge wall is defined only by the film.

15. The cartridge in accordance with claim 2, wherein the cartridge wall has a wall thickness of 0.1 mm.

16. The cartridge in accordance with claim 11, wherein the connection piece is configured to cooperate with one of a closure part and a mixer.

17. A cartridge comprising:

at least one reception chamber extending in a longitudinal direction, and being configured to dispense a medium, the reception chamber having a head part, a base part and a cartridge wall bounding the reception chamber, the head part having an outlet for the medium, the cartridge wall being defined by a film and the head part and the base part being respective fixed shape parts, the head part being sealingly and integrally connected to the film that defines the cartridge wall;

a separate protective film at an end of the reception chamber that is bounded by the head part, the separate protective film being configured to sealingly close the reception chamber at the end of the reception chamber; and a mixer having an inlet configured to cooperate with the outlet of the head part, the inlet being designed to puncture the protective film or to separate the protective film upon attachment of the mixer to the head part.

18. The cartridge in accordance with claim 17, wherein the inlet is moveable within the outlet.

19. The cartridge in accordance with claim 17, wherein the outlet is formed by an outlet passage that is molded onto the head part as a protruding tube, the inlet being moveable within the outlet passage.

20. The cartridge in accordance with claim 1, wherein the film is sealingly connected to the head part by a solidified liquid plastic, the film being at least partially overmolded with liquid plastic.

21. The cartridge in accordance with claim 1, wherein the protective film is intimately connected to the cartridge wall defined by the film.

* * * * *